US011933530B2

(12) United States Patent
Minchey et al.

(10) Patent No.: US 11,933,530 B2
(45) Date of Patent: Mar. 19, 2024

(54) HEATING, VENTILATION, AIR CONDITIONING, AND REFRIGERATION PROTECTION SYSTEM

(71) Applicant: Raytheon Company, Waltham, MA (US)

(72) Inventors: Rodney Minchey, Melissa, TX (US); Stephen T. Fasolino, McKinney, TX (US)

(73) Assignee: Raytheon Company, Tewksbury, MA (US)

( * ) Notice: Subject to any disclaimer, the term of this patent is extended or adjusted under 35 U.S.C. 154(b) by 0 days.

(21) Appl. No.: 17/573,394

(22) Filed: Jan. 11, 2022

(65) Prior Publication Data

US 2022/0235986 A1 Jul. 28, 2022

Related U.S. Application Data

(60) Provisional application No. 63/140,743, filed on Jan. 22, 2021.

(51) Int. Cl.
*F25B 49/02* (2006.01)
*F24F 11/48* (2018.01)
(Continued)

(52) U.S. Cl.
CPC ..... *F25B 49/022* (2013.01); *F24F 11/48* (2018.01); *F24F 11/49* (2018.01); *F24F 11/52* (2018.01);
(Continued)

(58) Field of Classification Search
CPC ..... F25B 45/00; F25B 49/02; F25B 49/022; F25B 49/005; F25B 2345/00;
(Continued)

(56) References Cited

U.S. PATENT DOCUMENTS 5,186,014 A 2/1993 Runk
5,243,828 A * 9/1993 Paige ..... F25B 45/00 62/149
(Continued)

FOREIGN PATENT DOCUMENTS

JP H06-123528 A 5/1994
WO WO-2020240158 A1 * 12/2020 ..... F04D 15/0088

*Primary Examiner* — Jonathan Bradford

(57) ABSTRACT

A HVACR protection system can include a pressure sensor to sense pressure within a refrigerant line coupled to a compressor; a timer; and a protection system controller. A compressor controller in communication with the protection system controller can control operation of the compressor and disable the compressor until successful completion of a vacuum test of the refrigerant line. The vacuum test can initiate upon the pressure sensor sensing the pressure being less than or equal to a vacuum test pressure, at which point the timer begins timing for a vacuum test time period. The vacuum test is successfully completed upon expiration of the vacuum test time period with the pressure remaining less than or equal to the vacuum test pressure for the vacuum test time period. The protection system controller can enable the compressor controller to operate the compressor upon successful completion of the vacuum test.

16 Claims, 3 Drawing Sheets

(51) Int. Cl.

| | |
|---|---|
| ***F24F 11/49*** | (2018.01) |
| ***F24F 11/52*** | (2018.01) |
| ***F25B 45/00*** | (2006.01) |
| ***F25B 49/00*** | (2006.01) |

(52) U.S. Cl.
CPC ..... *F25B 45/00* (2013.01); *F25B 49/005* (2013.01); *F25B 2345/001* (2013.01); *F25B 2345/003* (2013.01); *F25B 2500/222* (2013.01); *F25B 2600/02* (2013.01); *F25B 2600/0251* (2013.01); *F25B 2700/19* (2013.01)

(58) Field of Classification Search
CPC ..... F25B 2345/001; F25B 2345/002; F25B 2345/003; F25B 2500/22; F25B 2500/222; F25B 2600/02; F25B 2700/19; F24F 11/48; F24F 11/49; F24F 11/52
See application file for complete search history.

(56) References Cited

U.S. PATENT DOCUMENTS 5,353,603 A * 10/1994 Outlaw ..... F25B 45/00 62/149
2011/0088416 A1 4/2011 Koethler

* cited by examiner

HEATING, VENTILATION, AIR CONDITIONING, AND REFRIGERATION PROTECTION SYSTEM

CROSS REFERENCE TO RELATED APPLICATIONS

This application claims the benefit of U.S. Provisional Application No. 63/140,743, filed Jan. 22, 2021, and entitled, "Heating, Ventilation, Air Conditioning, and Refrigeration Protection System," which is incorporated by reference in its entirety herein.

BACKGROUND

Prior to filling a heating, ventilation, air conditioning, and refrigeration (HVACR) system with refrigerant, the refrigerant circuit is typically evacuated by "pulling a vacuum" to reduce the pressure inside the refrigerant circuit to a pressure below the atmospheric pressure outside the refrigerant circuit. Evacuation removes air and other vapors from inside the refrigerant circuit ("degassing stage") and boils off any liquid water from inside the refrigerant circuit by decreasing the pressure to below the vapor pressure of water at the ambient temperature ("dehydration stage"). The initial degassing stage generally happens quickly and easily. The dehydration stage, however, requires a deep vacuum maintained over a period of time. This can only be achieved by a "tight" system with no leaks. Accordingly, HVACR system manufacturers specify evacuation requirements for a vacuum that is to be maintained at or below a specified level for a specified time in order to ensure that refrigerant circuits are leak-free and that a proper evacuation has been performed.

BRIEF DESCRIPTION OF THE DRAWINGS

Features and advantages of the disclosure will be apparent from the detailed description which follows, taken in conjunction with the accompanying drawings, which together illustrate, by way of example, features of the disclosure; and, wherein.

Figure 1:
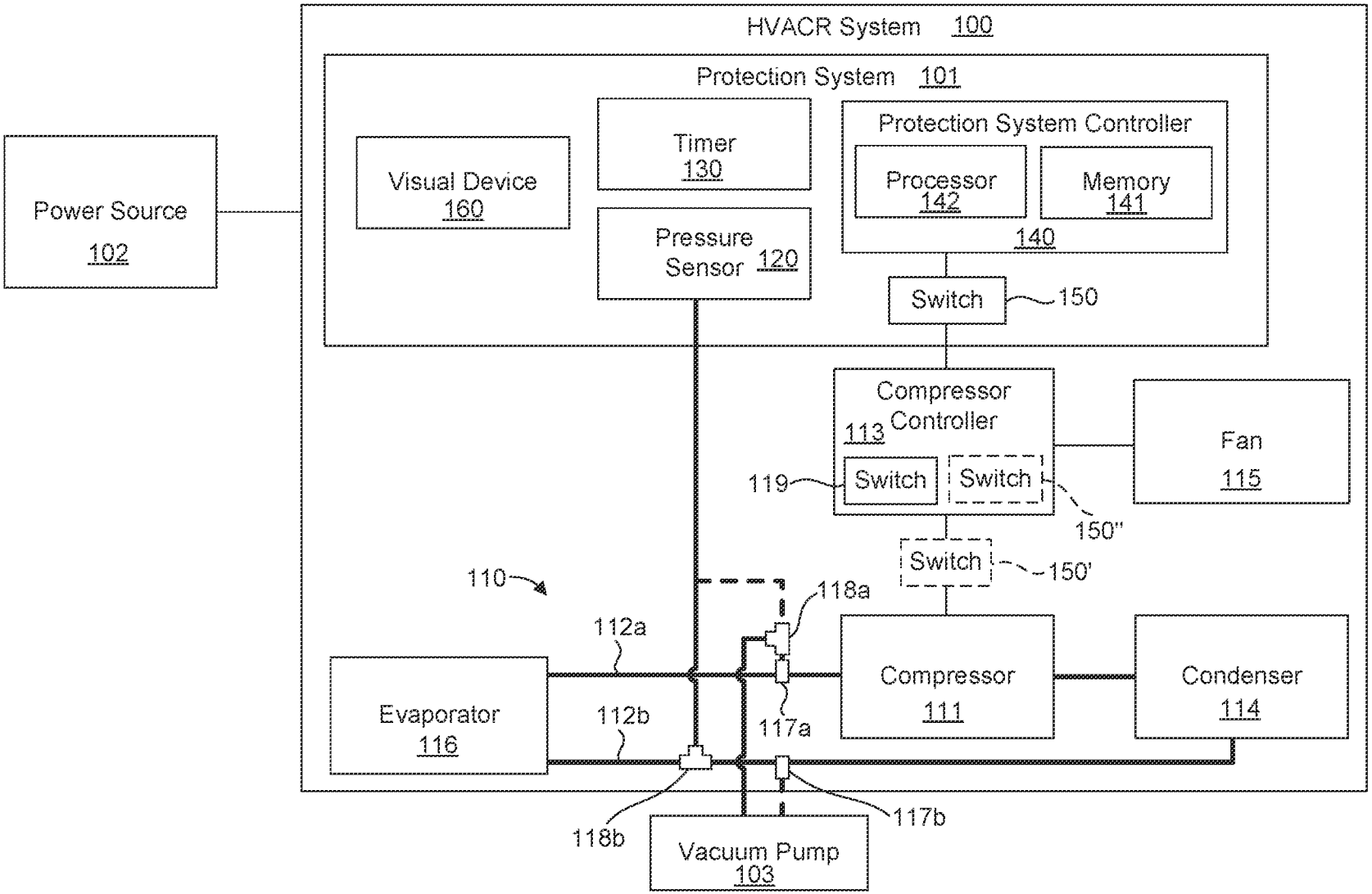
FIG. 1 is an illustration of a heating, ventilation, air conditioning, and refrigeration (HVACR) system in accordance with an example of the present disclosure.

Reference will now be made to the exemplary embodiments illustrated, and specific language will be used herein to describe the same. It will nevertheless be understood that no limitation of the scope of the disclosure is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of the disclosure is provided below and then specific examples are described in further detail later. This initial summary is intended to aid readers in understanding the examples more quickly, but is not intended to identify key features or essential features of the examples, nor is it intended to limit the scope of the claimed subject matter.

Although HVACR system manufacturers specify evacuation requirements, there is no current way to enforce these requirements. The HVACR system manufacturers rely on installation technicians to correctly follow the installation instructions and meet the evacuation requirements. Failure to achieve a proper evacuation can lead to premature compressor failures (e.g., due to acid caused by moisture), poorly functioning systems (e.g., due to non-condensable material in the refrigerant circuit or moisture freezing and restricting metering devices), and damage to the environment (e.g., due to escaped refrigerant caused by leaks), among other things.

Accordingly, a heating, ventilation, air conditioning, and refrigeration (HVACR) protection system is disclosed that ensures proper installation and evacuation of refrigerant circuits. This can protect HVACR systems from improperly functioning and premature failure and can therefore allow HVACR system manufacturers to increase warranty time and/or save on warranty costs. The HVACR protection system can include a pressure sensor operable to sense a pressure within a refrigerant line operably coupled to a compressor. The HVACR protection system can also include a timer. In addition, the HVACR protection system can include a protection system controller in communication with the pressure sensor, the timer, and a compressor controller operable to control operation of the compressor. The protection system controller can disable the compressor controller from operating the compressor until successful completion of a vacuum test of at least the refrigerant line. The protection system controller can be configured to initiate the vacuum test upon the pressure sensor sensing the pressure of the refrigerant line less than or equal to a vacuum test pressure, at which point the timer begins timing for a vacuum test time period. The vacuum test can be successfully completed upon expiration of the vacuum test time period and the pressure of the refrigerant line remained less than or equal to the vacuum test pressure for the duration of the vacuum test time period. Additionally, the protection system controller can be configured to enable operation of the compressor controller to operate the compressor upon successful completion of the vacuum test.

A heating, ventilation, air conditioning, and refrigeration (HVACR) system can include a compressor. The HVACR system can also include a refrigerant line operably coupled to the compressor. The HVACR system can further include a compressor controller operable to control operation of the compressor. In addition, the HVACR system can include a protection system operably coupled to the refrigerant line and the compressor controller to prevent operation of the compressor until successful completion of a vacuum test of at least the refrigerant line. The protection system can include a pressure sensor operable to sense a pressure within the refrigerant line. The protection system can also include a timer. Additionally, the protection system can include a protection system controller in communication with the pressure sensor, the timer, and the compressor controller. The protection system controller can disable the compressor controller from operating the compressor until successful completion of the vacuum test. The protection system controller can include one or more memories storing instructions, and one or more processors coupled to the one or more memories for executing the instructions to cause the one or more processors to receive pressure sensor output data generated by the pressure sensor, determine whether the pressure sensor sensed the pressure of the refrigerant line less than or equal to a vacuum test pressure, wherein upon the pressure of the refrigerant line being less than or equal to the vacuum test pressure, the vacuum test is initiated and the timer begins timing for a vacuum test time period, and wherein the vacuum test is successfully completed upon expiration of the vacuum test time period and the pressure of the refrigerant line remained less than or equal to the vacuum test pressure for the duration of the vacuum test time period, and enable operation of the compressor controller to operate the compressor upon successful completion of the vacuum test.

To further describe the present technology, examples are now provided with reference to the figures. With reference to FIG. 1, one embodiment of a heating, ventilation, air conditioning, and refrigeration (HVACR) system 100 is illustrated. In general, the HVACR system 100 can include a compressor 111, a refrigerant line (e.g., a suction line 112*a* and a liquid line 112*b*) operably coupled to the compressor 111, and a compressor controller 113 operable to control operation of the compressor 111. The HVACR system 100 can also include any other component typically found in HVACR systems known in the art, such as a condenser 114, a fan 115, and an evaporator 116. The compressor 111, the refrigerant line 112*a*, 112*b*, the condenser 114, and the evaporator 116 can form a refrigerant circuit 110. The compressor 111, the refrigerant line 112*a*, 112*b*, the compressor controller 113, the condenser 114, the fan 115, and the evaporator 116 can be typical of those components which are well-known in the art and arranged in any suitable configuration. The HVACR system 100 can also include an HVACR protection system 101, which is described in more detail below. The various components of the HVACR system 100 can be operably coupled to a power source 102 to enable powering the HVACR system 100.

HVACR system manufacturers typically require systems to be evacuated to a specified vacuum level (e.g., when installing/repairing the HVACR system and adding refrigerant to the system) and maintained below the specified vacuum level for a specified time. "Pulling" a vacuum creates negative pressure inside the system and allows for charging properly with refrigerant. It also removes vapor and debris from the system. A vacuum can be pulled by a vacuum pump 103 operably coupled to the HVACR system 100 in any suitable manner known in the art (e.g., via a coupling through one or more service ports 117*a*, 117*b* associated with one or both of the respective refrigerant lines 112*a*, 112*b*). The vacuum pump 103 can be connected to the HVACR system 100 in any suitable manner known in the art. In some examples, a T-connector or fitting 118*a*, 118*b* can be fitted to one or both of the respective refrigerant lines 112*a*, 112*b* (e.g., as shown in FIG. 1 formed integral to the refrigerant line 112*b* or coupled to the service port 117*a* of the refrigerant line 112*a*). The T-connector 118*a*, 118*b* can facilitate operably coupling the vacuum pump 103 and the protection system 101 to the refrigerant lines 112*a*, 112*b*, as discussed below.

Operation of the vacuum pump 103 can cause the pressure inside the refrigerant circuit 110 (e.g., inside the refrigerant lines 112*a*, 112*b*) to drop below atmospheric pressure. The vacuum pressure is typically an absolute pressure measured in microns of mercury (Hg). The lower the absolute pressure, the deeper the vacuum below atmospheric pressure. HVACR system manufacturers typically require a vacuum test pressure less than or equal to an absolute pressure about 1000 microns of Hg (e.g., a vacuum test pressure limit of about 500 microns of Hg or about 400 microns of Hg).

The protection system 101 can help ensure that manufacturer requirements (e.g., refrigerant circuit 110 test for required vacuum for required length of time) have been met, by preventing operation of the compressor 111 until successful completion of a vacuum test of the refrigerant circuit 110 (e.g., including at least the refrigerant lines 112*a*, 112*b*). The protection system 101 can be operably coupled to one or both of the refrigerant lines 112*a*, 112*b* and the compressor controller 113. In general, the protection system 101 can include a pressure sensor 120, a timer or clock 130, and a protection system controller 140 in communication with the pressure sensor 120, the timer or clock 130, and the compressor controller 113. The protection system 101 can measure the (vacuum) pressure of the refrigerant circuit 110 (e.g., including at least the refrigerant lines 112*a*, 112*b*) using the pressure sensor 120. The pressure measurement can occur as the vacuum pump 103 is operating. Once a specified vacuum test pressure has been achieved, the timer 130 starts and runs for a specified vacuum test time period. If the required vacuum test pressure has been maintained for the required vacuum test time period, then the protection system 101 will allow the HVAC system (e.g., the compressor 111) to operate. The refrigerant lines 112*a*, 112*b* can then be filled with refrigerant and the HVAC system will operate in the usual manner.

The pressure sensor 120 can be operably coupled to one or both of the refrigerant lines 112*a*, 112*b* (e.g., via the T-connector 118*a*, 118*b*) to sense a pressure within the refrigerant line 112*a*, 112*b* and can provide pressure data to the protection system controller 140. The pressure sensor 120 can be operable to measure an absolute pressure covering a range of pressures that includes the vacuum test pressure required by the HVACR system manufacturer (e.g., less than or equal to about 1000 microns of Hg). The pressure sensor 120 can be of any suitable type or configuration known in the art that can sense the required pressure at the required resolution (e.g., in microns of Hg).

The timer or clock 130 can measure elapsed time of the vacuum test and can provide time data to the protection system controller 140. The timer 130 can be or include any suitable type of timer or clock known in the art to provide time information or data, such as, broadly speaking, at least one of a hardware clock or a software clock. The vacuum test time period can be any length of time required by an HVACR system manufacturer or another suitable time period selected by a maintenance technician (e.g., based on industry recognized best practices). In some examples, the vacuum test time period is less than or equal to about 6 hours (e.g., less than or equal to about 4 hours or less than or equal to about 2 hours).

The protection system controller 140 can disable the compressor controller 113 from operating the compressor 111 until successful completion of the vacuum test. The protection system controller 140 can be configured to initiate the vacuum test upon the pressure sensor 120 sensing the pressure of the refrigerant line 112*a*, 112*b* less than or equal to a vacuum test pressure, at which point the timer 130 begins timing for a vacuum test time period. The vacuum test is successfully completed upon expiration of the vacuum test time period and the pressure of the refrigerant line 112*a*, 112*b* remained less than or equal to the vacuum test pressure for the duration of the vacuum test time period. The protection system controller 140 can enable operation of the compressor controller 113 to operate the compressor 111 upon successful completion of the vacuum test.

In some examples, the protection system controller 140 can include or otherwise be associated with one or more memories 141, which can store instructions. The one or more memories 141 can be random access memory (RAM), read only memory (ROM), flash memory, a solid-state drive, a memory card, a hard drive, an optical disk, a floppy disk, a magnetic tape, or any other memory components. The protection system controller 140 can also include one or more processors 142 operable with the one or more memories 141. The one or more processors 142 can execute the instructions to cause the one or more processors 142 to receive pressure sensor output data generated by the pressure sensor 120. The one or more processors 142 can also execute the instructions to cause the one or more processors 142 to determine whether the pressure sensor 120 sensed the pressure of the refrigerant line 112*a*, 112*b* less than or equal to a vacuum test pressure. Upon the pressure of the refrigerant line 112*a*, 112*b* being less than or equal to the vacuum test pressure, the vacuum test is initiated and the timer 130 begins timing for a vacuum test time period. The vacuum test is successfully completed upon expiration of the vacuum test time period and the pressure of the refrigerant line 112*a*, 112*b* remained less than or equal to the vacuum test pressure for the duration of the vacuum test time period. Additionally, the one or more processors 142 can execute the instructions to cause the one or more processors 142 to enable operation of the compressor controller 113 to operate the compressor 111 upon successful completion of the vacuum test.

The term "executable" can mean a program file that is in a form that can be executed by the one or more processors 142. For example, a program in a higher-level language can be compiled into machine code in a format that can be loaded into a random access portion of the one or more memories 141 and executed by the one or more processors 142, or source code can be loaded by another executable program and interpreted to generate instructions in a random access portion of the memory to be executed by a processor. The executable program can be stored in any portion or component of the one or more memories 141.

The protection system 101 can be utilized for initial start-up of the HVAC system 100 and/or the protection system 101 can be configured to reset any time the pressure inside the refrigerant line 112*a*, 112*b* drops below a certain threshold (e.g., indicating a leak that would necessitate repair and refill of the refrigerant system).

In some examples, the HVACR protection system 101 can include a visual device 160 operable to indicate information and/or data to a user, such as at least one of the pressure, the vacuum test pressure, the vacuum test time period, timer information, the vacuum test has not started, the vacuum test is in progress, or successful completion of the vacuum test. The visual device 160 can be of any suitable type or configuration known in the art, such as at least one of a display or a light. The display can be of any suitable type known in the art, such as an LCD display, an LED display, etc. and can be used to present any suitable type of information to the user in any suitable format (e.g., alphanumeric characters, graphics, etc. to indicate the pressure, the vacuum test pressure, the vacuum test time period, timer information, etc.). The light can be of any suitable type known in the art (e.g., an LED) and can be of any suitable color. In some examples, multiple colors can be illuminated (e.g., by one or more lights) to indicate information to the user (e.g., protection system 101 status, such as the vacuum test has not started, the vacuum test is in progress, or successful completion of the vacuum test). Thus, the visual device 160 can be operable to indicate to a technician the status of the vacuum test and indicate when the refrigerant circuit 110 is ready to be filled with refrigerant upon successful completion of the vacuum test.

In some examples, the protection system controller 140 can be operable to store a record of the vacuum test, such as a date/time stamp of various events of the vacuum test (e.g., a pressure history during the vacuum test, test results, date/time when power was first applied to the compressor 111 following successful completion of the vacuum test, etc.) on the one or more memories 141. Such a record can provide a way to ensure that the proper procedure has been followed, which can be verified at any time by accessing the record. In some examples, a technician can access the record data via a wired/wireless communication with the one or more memories 141, a removable memory (e.g., download the record onto a removable memory, such as a flash memory). In some examples, the record data can be communicated to, and stored by, an application on a mobile device, which can be utilized by a technician. In some examples, the record data can be communicated via a cellular network and/or the internet to a technician and/or a manufacturer for evaluation.

Operation of the compressor controller 113 can be enabled by the protection system controller 140 in any suitable manner known in the art. For example, a switch 150 can be included that is operable to enable operation of the compressor controller 113. For instance, initially, the switch 150 can be open thereby disabling operation of the compressor controller 113 until successful completion of the vacuum test. The protection system controller 140 can close the switch 150 to enable operation of the compressor controller 113. In some examples, the protection system 101 can be operably coupled to the power source 102 between the power source 102 and the compressor controller 113. The switch 150 can be configured to control the supply of power to the compressor controller 113. In some examples, the compressor controller 113 can include a control switch 119 (e.g., a contactor) that controls operation of the compressor 111. In this case, the switch 150 can control the supply of power to the control switch 119.

In some examples, a switch 150' (or a switch 150" included in the compressor controller 113 control circuitry) can be operably coupled between the compressor controller 113 and the compressor 111 to control the ability of the compressor controller 113 to control the compressor 111. Initially, the switch 150' (or the switch 150") can be open thereby disabling the ability of the compressor controller 113 to control operation of the compressor 111 until successful completion of the vacuum test. The protection system controller 140 can close the switch 150' (or the switch 150") to enable the compressor controller 113 to control the compressor 111. In some examples, the switch 150' (or the switch 150") can be configured to control a control signal and/or the supply of power to the compressor 111.

The switches 150, 150', 150" can have any suitable configuration or construction (e.g., hardware and/or software defined switches). In one aspect, the switches 150, 150', 150" can be tamper resistant, such as by being built-in or integrated with the protection system controller 140 or the compressor controller 113 (e.g., integrated with components on a circuit board).

In one aspect, the protection system 101 in the example illustrated in FIG. 1 can be implemented as a retro-fit or add-on component to a typical HVACR system, which can be installed during installation of the HVACR system by a field technician, for example. In this case, various components of the protection system 101 and the HVACR system (e.g., the protection system controller 140 and the compressor controller 113) can be separate and distinct components. In one aspect, a retro-fit or add-on protection system 101 can utilize existing components of the HVACR system, such as a switch (e.g., the switch 150") in the compressor controller 113 control circuitry.

Figure 2:
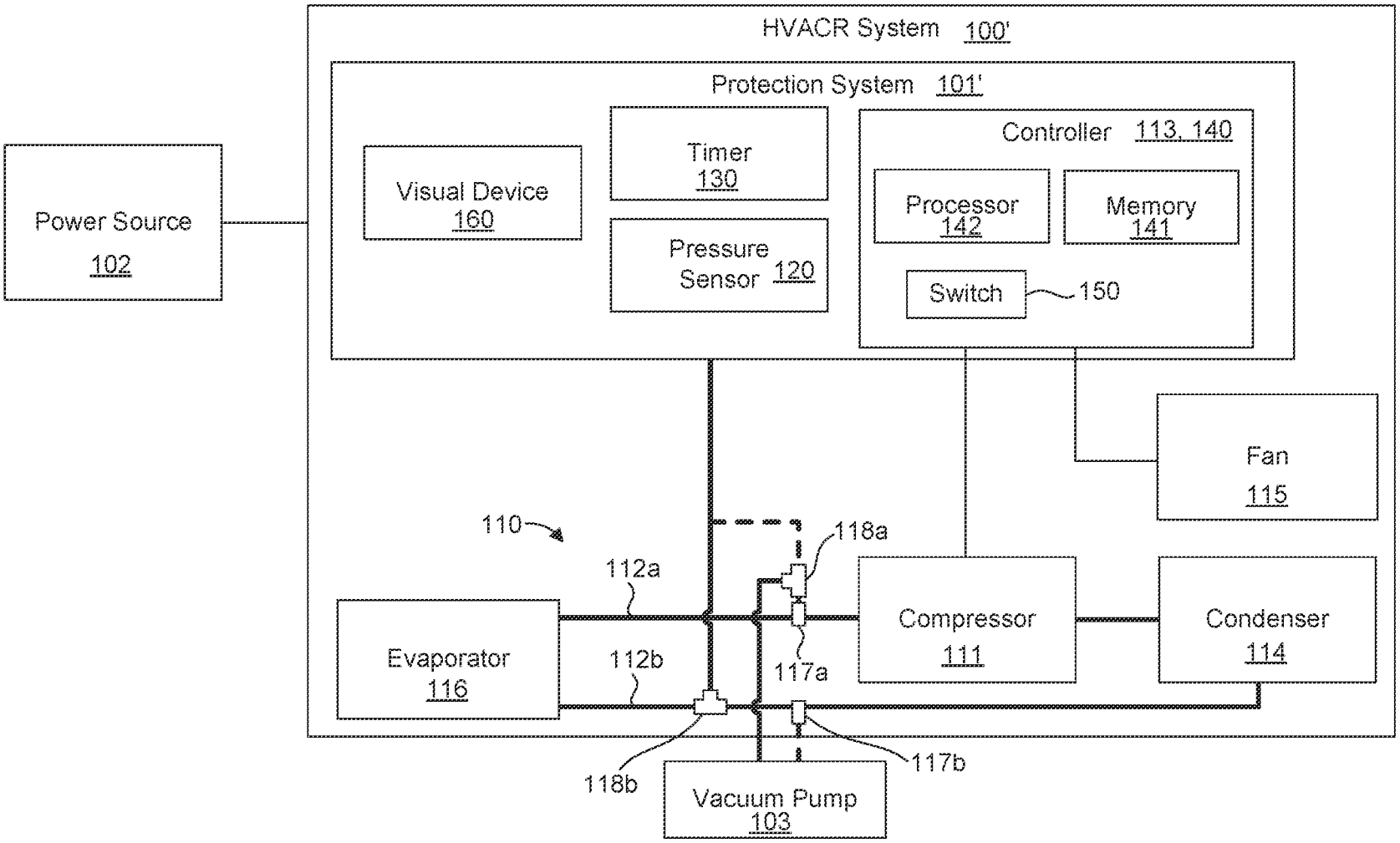
FIG. 2 is an illustration of an HVACR system in accordance with another example of the present disclosure.

On the other hand, FIG. 2 illustrates an example HVACR system 100' where the protection system 101' is integrated with applicable components of the HVACR system (e.g., as supplied by the manufacturer). In this case, various components of the protection system 101' and the HVACR system (e.g., the protection system controller 140 and the compressor controller 113) can be integrated and/or shared components. In one example, the compressor controller 113, the protection system controller 140, the timer 130, and/or the pressure sensor 120 can be at least partially formed on the same or a common circuit board. In some examples, the protection system controller 140, the compressor controller 113, the timer 130, and/or the pressure sensor 120 can share components (e.g., hardware, such as the one or more memories 141 and/or the one or more processors 142, the timer 130, etc.), as applicable.

Operation of the compressor controller 113 can be enabled by the protection system controller 140 in any suitable manner described herein. For example, the switch 150 can be operable to enable operation of the compressor controller 113 and/or enable communication between the compressor controller 113 and the compressor 111 (e.g., as described above with reference to the switches 150, 150', 150"), such as by controlling the supply of power to the compressor controller 113 and/or the compressor 111 or by controlling a control signal to the compressor 111.

Figure 3:
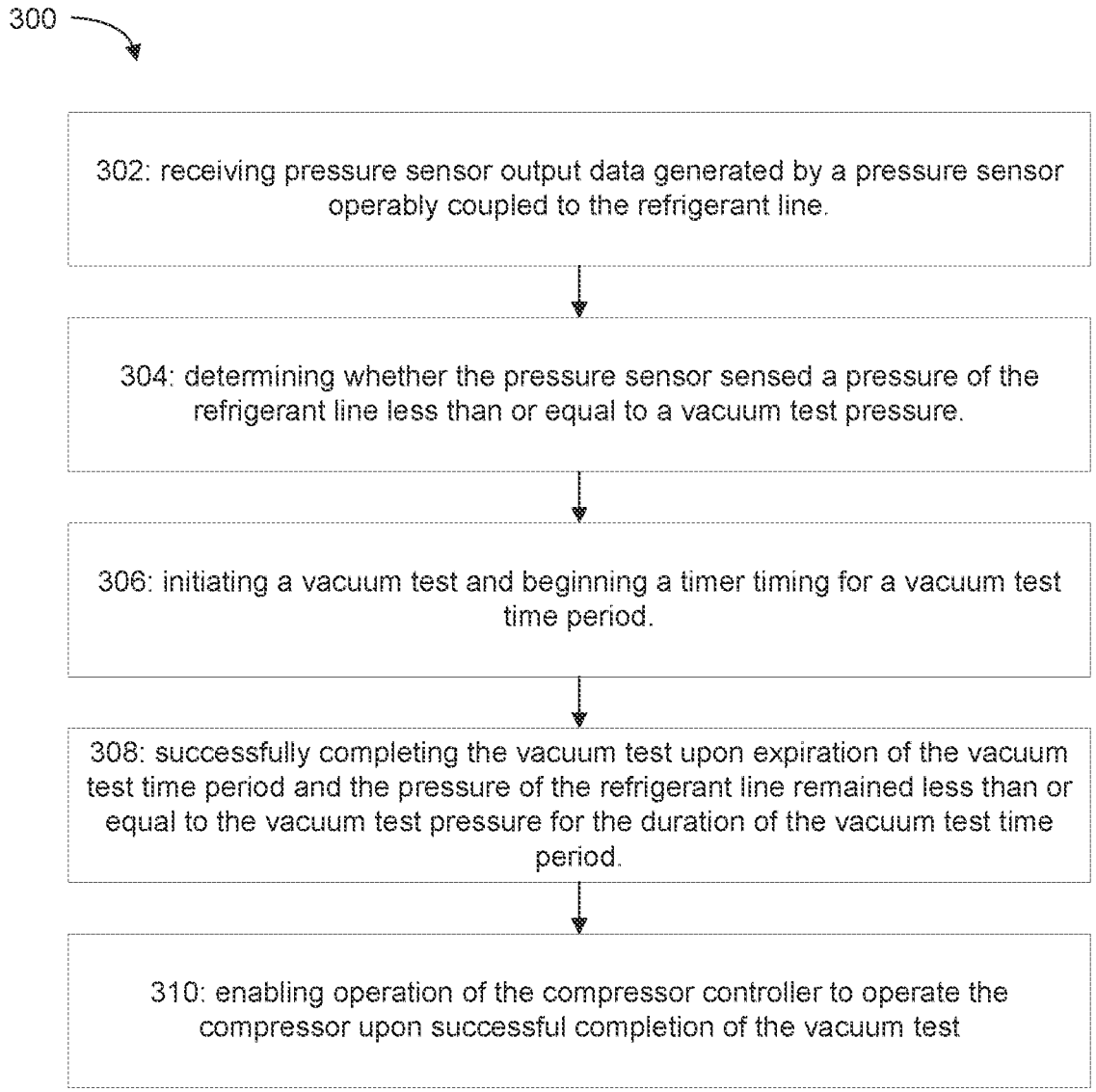
FIG. 3 illustrates a computer implemented method for protecting an HVACR system.

In accordance with one example, a computer implemented method 300, illustrated in FIG. 3, is disclosed for protecting an HVACR system comprising a compressor, a refrigerant line operably coupled to the compressor, and a compressor controller operable to control operation of the compressor. The method 300 can comprise a step 302 of receiving pressure sensor output data generated by a pressure sensor operably coupled to the refrigerant line. The method 300 can further comprise a step 304 of determining whether the pressure sensor sensed a pressure of the refrigerant line less than or equal to a vacuum test pressure. Upon the pressure of the refrigerant line being less than or equal to the vacuum test pressure, a vacuum test is initiated in a step 306 of the method 300 and a timer begins timing for a vacuum test time period. At step 308 the vacuum test is successfully completed upon expiration of the vacuum test time period and the pressure of the refrigerant line remained less than or equal to the vacuum test pressure for the duration of the vacuum test time period. Additionally, the method 300 can comprise a step 310 of enabling operation of the compressor controller to operate the compressor upon successful completion of the vacuum test. It is noted that no specific order is required in this method 300, though generally in one embodiment, these method steps can be carried out sequentially.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Although the disclosure may not expressly disclose that some embodiments or features described herein may be combined with other embodiments or features described herein, this disclosure should be read to describe any such combinations that would be practicable by one of ordinary skill in the art. The user of "or" in this disclosure should be understood to mean non-exclusive or, i.e., "and/or," unless otherwise indicated herein.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A heating, ventilation, air conditioning, and refrigeration (HVACR) protection system, comprising:

a pressure sensor operable to sense a pressure within a refrigerant line operably coupled to a compressor;

a timer; and a protection system controller in communication with the pressure sensor, the timer, and a compressor controller operable to control operation of the compressor, the protection system controller actively disabling the compressor controller from operating the compressor until successful completion of a vacuum test of at least the refrigerant line, wherein the protection system controller is configured to:

initiate the vacuum test upon the pressure sensor sensing the pressure of the refrigerant line less than or equal to a vacuum test pressure, at which point the timer begins timing for a vacuum test time period, wherein the vacuum test is successfully completed upon expiration of the vacuum test time period and the pressure of the refrigerant line remaining less than or equal to the vacuum test pressure for the duration of the vacuum test time period, and enable operation of the compressor controller to operate the compressor upon successful completion of the vacuum test.

2. The HVACR protection system of claim 1, further comprising a switch operable to enable operation of the compressor controller.

3. The HVACR protection system of claim 1, wherein the pressure sensor is operable to measure an absolute pressure of less than or equal to about 1000 microns of mercury.

4. The HVACR protection system of claim 1, wherein the vacuum test pressure is less than or equal to an absolute pressure of about 1000 microns of mercury.

5. The HVACR protection system of claim 1, wherein the vacuum test time period is less than or equal to about 6 hours.

6. The HVACR protection system of claim 1, further comprising a display or an indicator operable to indicate at least one of the pressure, the vacuum test pressure, the vacuum test time period, timer information, the vacuum test has not started, the vacuum test is in progress, or successful completion of the vacuum test.

7. The HVACR protection system of claim 1, wherein the protection system controller comprises at least one of a processor or computer memory.

8. A heating, ventilation, air conditioning, and refrigeration (HVACR) system, comprising:

a compressor;

a refrigerant line operably coupled to the compressor;

a compressor controller operable to control operation of the compressor; and a protection system operably coupled to the refrigerant line and the compressor controller to prevent operation of the compressor until successful completion of a vacuum test of at least the refrigerant line, the protection system comprising:

a pressure sensor operable to sense a pressure within the refrigerant line, a timer, and a protection system controller in communication with the pressure sensor, the timer, and the compressor controller, the protection system controller actively disabling the compressor controller from operating the compressor until successful completion of the vacuum test, the protection system controller comprising:

one or more memories storing instructions;

one or more processors coupled to the one or more memories for executing the instructions to cause the one or more processors to:

receive pressure sensor output data generated by the pressure sensor, determine whether the pressure sensor sensed the pressure of the refrigerant line less than or equal to a vacuum test pressure, wherein upon the pressure of the refrigerant line being less than or equal to the vacuum test pressure, the vacuum test is initiated and the timer begins timing for a vacuum test time period, and wherein the vacuum test is successfully completed upon expiration of the vacuum test time period and the pressure of the refrigerant line remaining less than or equal to the vacuum test pressure for the duration of the vacuum test time period, and enable operation of the compressor controller to operate the compressor upon successful completion of the vacuum test.

9. The system of claim 8, further comprising a switch operable to enable operation of the compressor controller.

10. The system of claim 8, wherein the pressure sensor is operable to measure an absolute pressure of less than or equal to about 1000 microns of mercury.

11. The system of claim 8, wherein the vacuum test pressure is less than or equal to an absolute pressure of about 1000 microns of mercury.

12. The system of claim 8, wherein the vacuum test time period is less than or equal to about 6 hours.

13. The system of claim 8, wherein the compressor controller comprises a contactor.

14. The system of claim 8, wherein the compressor controller and the protection system controller are at least partially formed on a circuit board.

15. The system of claim 8, wherein the refrigerant line comprises at least one of a suction line or a liquid line.

16. A computer implemented method for protecting a heating, ventilation, air conditioning, and refrigeration (HVACR) system comprising a compressor, a refrigerant line operably coupled to the compressor, and a compressor controller operable to control operation of the compressor, the method comprising:

receiving pressure sensor output data generated by a pressure sensor operably coupled to the refrigerant line;

determining whether the pressure sensor sensed a pressure of the refrigerant line less than or equal to a vacuum test pressure, wherein upon the pressure of the refrigerant line being less than or equal to the vacuum test pressure, a vacuum test is initiated and a timer begins timing for a vacuum test time period, and wherein the vacuum test is successfully completed upon expiration of the vacuum test time period and the pressure of the refrigerant line remaining less than or equal to the vacuum test pressure for the duration of the vacuum test time period; and enabling active operation of the compressor controller to operate the compressor upon successful completion of the vacuum test.

* * * * *